United States Patent [19]

Chen

[11] Patent Number: 4,964,507

[45] Date of Patent: Oct. 23, 1990

[54] PACKING CASES FOR FROZEN SHRIMPS

[76] Inventor: Hanks Chen, No. 63, Guu Shan 1st Road, Kaohsiung, Taiwan

[21] Appl. No.: 442,737

[22] Filed: Nov. 28, 1989

[51] Int. Cl.[5] ..... B65D 43/00

[52] U.S. Cl. ..... 206/557

[58] Field of Search ..... 206/557

[56] References Cited

U.S. PATENT DOCUMENTS 2,918,379 12/1959 Lurig ..... 206/557

3,464,832 9/1969 Mullinix ..... 206/557

3,863,833 2/1975 Swett et al. ..... 206/557

3,894,679 7/1975 Reifer et al. ..... 206/557

*Primary Examiner*—Joseph Man-Fu Moy

*Attorney, Agent, or Firm*—Bacon & Thomas

[57] ABSTRACT

A packing case for frozen shrimps having a case body provided with a protruding-up curved section in the bottom to consume the inflating pressure during the freezing course so as to keep the original case shape after frozen.

1 Claim, 3 Drawing Sheets

PACKING CASES FOR FROZEN SHRIMPS

BACKGROUND OF THE INVENTION

Conventional packing cases for frozen shrimps or lobsters have the structure shown in FIG. 1 and 2, having a rectangular case body 1 for containing a proper volume of water and shrimps (not shown in Figures) and a plastic film 11 glued to seal the case body 1.

In the course of freezing the conventional packing case, the upper central section of the case can bulge up owing to the inflating pressure produced in the course of freezing, because the central section is the slowest in freezing. Then the plastic film has its central section bulging up as FIG. 2 shows. In other words, the packing case is deformed after frozen, losing its balanced outward shape and being very inconvenient for piling up in transportation.

SUMMARY OF THE INVENTION

In view of the defect of conventional packing cases of frozen shrimps, this invention has been devised to furnish those, which do not deform after frozen.

The packing case for frozen shrimps in accordance with the present invention comprises a case body provided with a protruding-up curved section in the middle of the bottom, and a plurality of vertical protruding ridges properly spaced apart in the circumferential sides, and a plastic film.

The protruding-up curved section has an empty recess under it so that when said section is compressed by the inflating pressure in the freezing course. It will be deformed to bulge down toward the empty recess instead of bulging upward. But the whole outer shape of the packing case is not deformed.

DETAILED DESCRIPTION OF THE INVENTION

Figure 1:
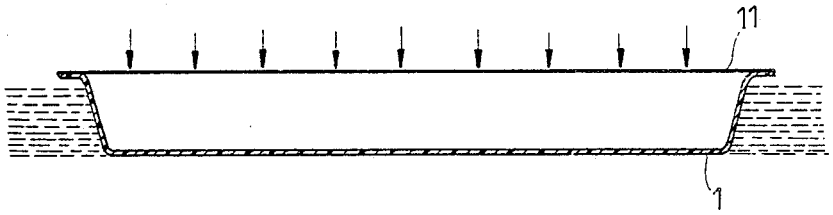
FIG. 1 is a cross-sectional view of a conventional packing case for frozen shrimps.
Figure 2:
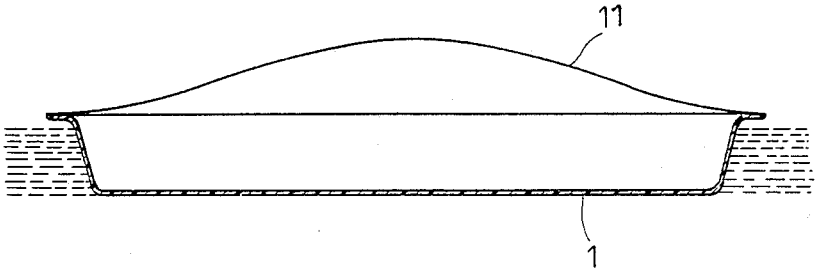
FIG. 2 is a cross-sectional view of a conventional case deformed after frozen.
Figure 3:
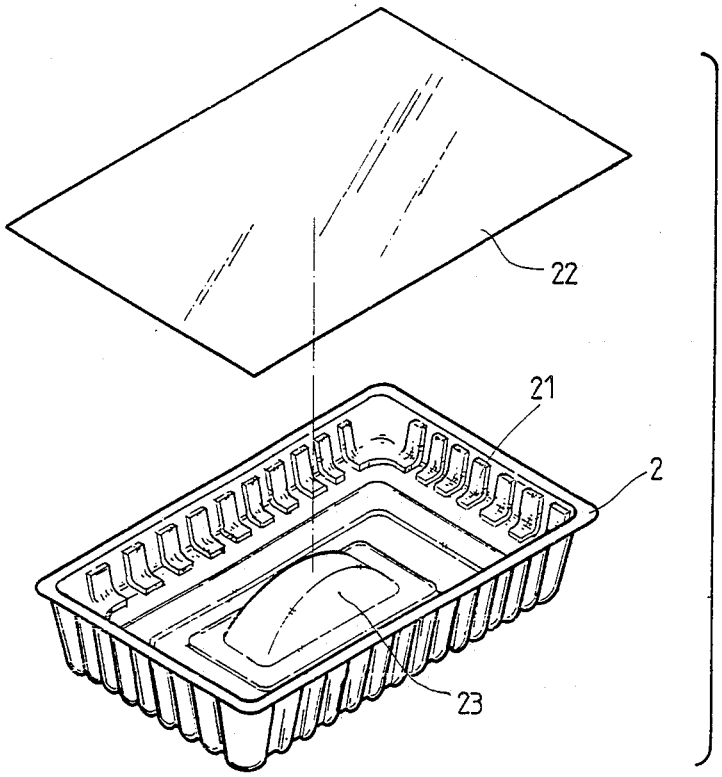
FIG. 3 is a perspective view of the packing case for frozen shrimps in accordance with the present invention.
Figure 4:
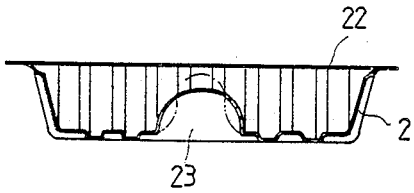
FIG. 4 is a cross-secctional view of the cross side of the packing case for frozen shrimps in accordance with the present invention.
Figure 5:
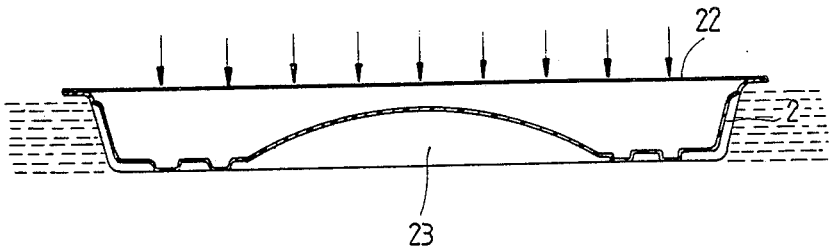
FIG. 5 is a cross-sectional view of the lengthwise side of the packing case for frozen shrimps in accordance with the present invention.
Figure 6:
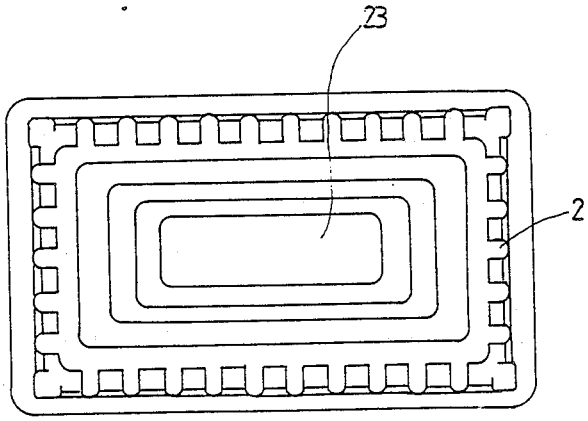
FIG. 6 is an upside view of the packing case for frozen shrimps in accordance with the present invention.

As FIG. 3, 4 and 5 show, the packing case for frozen shrimps in accordance with the present invention comprises a case body 2 provided with a plurality of vertical protruding reinforcing ridges 21 properly spaced apart in the circumferential sides and a protruding-up curved section 23 in the middle of the bottom, and a plastic film 22 for sealing the packing case after shrimps are packed in the case body 1.

The feature of this packing case is the protruding-up curved section 23 in the bottom, which can consume the inflating pressure that the contents of the case give in the course of freezing the shrimps in the case, bulging toward the empty recess under it instead of bulging upward as a conventional packing case does. Therefore, the whole outer shape of this packing case cannot be deformed after the course of freezing shrimps so that it is very convenient for piling up one by one in a stable condition in transporting.

What is claimed is:

1. A packing case for frozen shrimps comprising a case body provided with a protruding-up curved section in the middle of the bottom, said protruding-up curved section possible to consume the inflating pressure in the course of freezing shrimps so that the packing case may not be deformed during the freezing course, keeping its outer shape as original so as to be convenient for transporting.

* * * * *